US006791021B2

(12) United States Patent
Aoki

(10) Patent No.: US 6,791,021 B2
(45) Date of Patent: Sep. 14, 2004

(54) AUTOMATIC CHORD PROGRESSION CORRECTION APPARATUS AND AUTOMATIC COMPOSITION APPARATUS

(75) Inventor: Eiichiro Aoki, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/906,556

(22) Filed: Jul. 16, 2001

(65) Prior Publication Data

US 2002/0029685 A1 Mar. 14, 2002

(30) Foreign Application Priority Data

Jul. 18, 2000 (JP) ..... 2000-218107

(51) Int. Cl.[7] ..... G10H 1/38; G10H 7/00

(52) U.S. Cl. ..... 84/613; 84/609; 84/615; 84/637; 84/649

(58) Field of Search ..... 84/600–602, 609–613, 84/615, 618, 637, 649–653, 656, 666–669

(56) References Cited

U.S. PATENT DOCUMENTS 5,218,153 A * 6/1993 Minamitaka ..... 84/613
5,723,803 A 3/1998 Kurakake
6,143,971 A 11/2000 Aoki et al.

* cited by examiner

*Primary Examiner*—Marlon Fletcher
(74) *Attorney, Agent, or Firm*—Rossi & Associates

(57) ABSTRACT

For both an automatic chord correction and an automatic composition, it is required to correct a part of a series of given chords in order to have a musically natural connection between adjacent chords. A series of chords "a", "b", "c", "d", "e", "f" (each letter means one kind of chords) for a music is selected by a user. If two chords "c" and "d" among the series of chords "a", "b", "c", "d", "e", "f" are changed into different ones, according to the user's preference or to make them more appropriate to the motif melody, the chord "b" adjacent to the changed "c" is automatically corrected into "b*" so that both chord connections from "a" to "b*" and from "b*" to the changed "c" can be more musically natural. Similarly, the chord "e" adjacent to the changed "d" is automatically corrected into "e*" so that both chord connections from the changed "d" to "e*" and from "e*" to "f" can be more musically natural.

17 Claims, 7 Drawing Sheets

| a | b:Bm7b5 | c | d | e:Am | f |
|---|---|---|---|---|---|

Candidate1 : Am7 Dm7
Candidate2 : Em C6
Candidate3 : C7 F
Candidate4 : G6 Am
Candidate5 : C F
Candidate6 : Em D7
Candidate7 : A7 Dm7

AUTOMATIC CHORD PROGRESSION CORRECTION APPARATUS AND AUTOMATIC COMPOSITION APPARATUS

BACKGROUND OF THE INVENTION

1. Field of the Invention

The present invention relates firstly to a chord progression correction apparatus which modifies a part of a series of chords in order to make it more musically appropriate, to a method of such chord progression correction, and to a computer readable storage medium storing a computer program applied to the apparatus. Secondly, it relates to an automatic composition apparatus which automatically generates a melody of a complete music with given melody generation data relating to a musically highlighted portion and a series of given chords, to a method of such automatic composition, and to a computer readable storage medium storing a computer program applied to the apparatus.

2. Description of the Related Art

It is already known, in an electronic music system, that a series of chords selected by a user from among plural series of chords prepared beforehand according to a chord progression rule, can be added to a melody performed by a user or played automatically. It has also become an established knowledge that a complete melody of music can be composed automatically by using an adequate series of chords selected from among plural series of chords, and necessary data particularly inputted for musical melody generation which corresponds to various musical elements such as musical nuance, music key, motif melody, musical structure, information of pitch (e.g., register, pitch fluctuation).

In both cases when an adequate series of chords is to be given to a melody performance or automatic melody play and when a proper melody is to be automatically composed, it is often desired to particularize a music by modifying a part of the selected chord corresponding to a special portion of musical motif or musically highlighted portion. However, if a part of such selected set of chords is too easily changed by user's primitive preference or hasty aim to fit better to a given motif melody, the chord progression often becomes less smooth and subject to miss naturalness at the point before and after such chord connection. Additionally, it has not yet been proposed in any of prior arts to compose a music automatically in consideration of "musically highlighted portion" mentioned above.

SUMMARY OF THE INVENTION

In order to deal with the aforementioned problem, it is an object of the present invention to provide a chord progression correction apparatus which generates no defect of unnaturalness at the chord connection point when a part of a series of chords is changed, to provide a chord progression correction method of the same function, and to provide a computer readable storage medium applied to the chord progression correction apparatus. It is also an object of the invention to provide an automatic composition apparatus in consideration of the "musically highlighted portion", an automatic composition method of the same function, and a computer readable storage medium storing a program applied to the automatic composition apparatus.

In order to achieve the aforesaid object, the first characteristic feature of this invention lies in an automatic chord progression correction apparatus, the apparatus comprising chord change means for changing a part of a series of given chords and chord correction means for correcting a chord adjacent to the changed part to generate a new series of chords bringing a musically natural chord connection.

The above mentioned chord correction means includes, for instance, a table memorizing conditions for a musically natural chord connection, and chord determination means for determining the chord adjacent to the changed part by referring to the table according to two chords which are positioned on the both sides of the chord adjacent to the changed part, one of the two chords being included in the changed part, and another one of the two chords being included in the series of given chords.

From another viewpoint, the first feature of the invention lies both in a chord progression correction method based on the idea corresponding to the chord progression correction apparatus and in a computer readable storage medium which stores the program of the same function.

According to the first feature of the invention, when a part of the series of given chords is changed either by user's preference or in order to make more appropriate to a given motif melody, a new series of chords can be generated automatically to make the chord connection musically more natural by correcting a chord adjacent to the changed chord found in the series of given chord. Therefore, a musically desired chord progression can always be obtained, even if a part of a series of given chords is changed under various conditions.

The second characteristic feature of this invention lies in a chord progression correction apparatus which replaces a part of a series of given chords by a chord appropriate to a given melody, the apparatus comprising detection means for detecting a chord appropriate to the given melody and whose connection with the series of given chords is musically natural, and chord replacement means for replacing the part of the series of given chords by the detected chord.

The above mentioned chord detection means, for instance, comprises chord list up means for listing up a plurality of chords appropriate to the given melody, and chord determination means for determining one chord from among the plurality of listed up chords to bring a musically natural connection with the series of given chords.

From another standpoint, the second feature of this invention lies both in a chord progression correction method based on the idea corresponding to the chord progression correction apparatus and in a computer readable storage medium which stores the program of the same function.

According to the second feature of the invention, when a part of a series of given chords is to be replaced by a different chord which fits more favorably a given melody, an appropriate chord is detected for the given melody and its chord progression in connection with the series of given chords becomes musically natural. Then, the part of the series of given chords is replaced by the detected chord is. Therefore, in case of an automatic composition system too, when a part of a series of given chords is aimed to be replaced to fit better a given motif melody, a musically natural chord progression can be automatically obtained.

The third characteristic feature of this invention lies in an automatic composition apparatus which automatically composes a music with both given melody generation data relating to a musically highlighted portion and a series of given chords, the apparatus comprising addition means for adding the musically highlighted portion as a part of a music, and setting means for setting both the melody generation data relating to the musically highlighted portion and a part of chords corresponding to the musically highlighted portion among the series of given chords for the added musically highlighted portion.

According to the third feature of the invention, it becomes possible to compose automatically a music with full of variety by placing a given musically highlighted passage at the beginning and/or the end of a music or by using it repetitively in a music so that the music may have several outstanding portions.

Preferably, the above mentioned automatic composition apparatus further comprises chord correction means for correcting a chord set for the added musically highlighted portion to bring a musically natural connection with the series of given chords. With such additional chord correction means, the given chord progression does not give unnatural impression when a musically highlighted portion is added, which makes the automatic composition apparatus be capable of composing automatically musical pieces of high quality.

Preferably, the above mentioned automatic composition apparatus further comprises transposition data adding means for adding transposition data defining a nature of transposition to the melody generation data assigned at the added musically highlighted portion. With such transposition data adding means, the automatically composed music can have still richer highlighted passages.

From another point of view, the third feature of this invention lies both in an automatic composition method based on the idea corresponding to the automatic composition apparatus and in a computer readable storage medium which stores the program of the same function.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
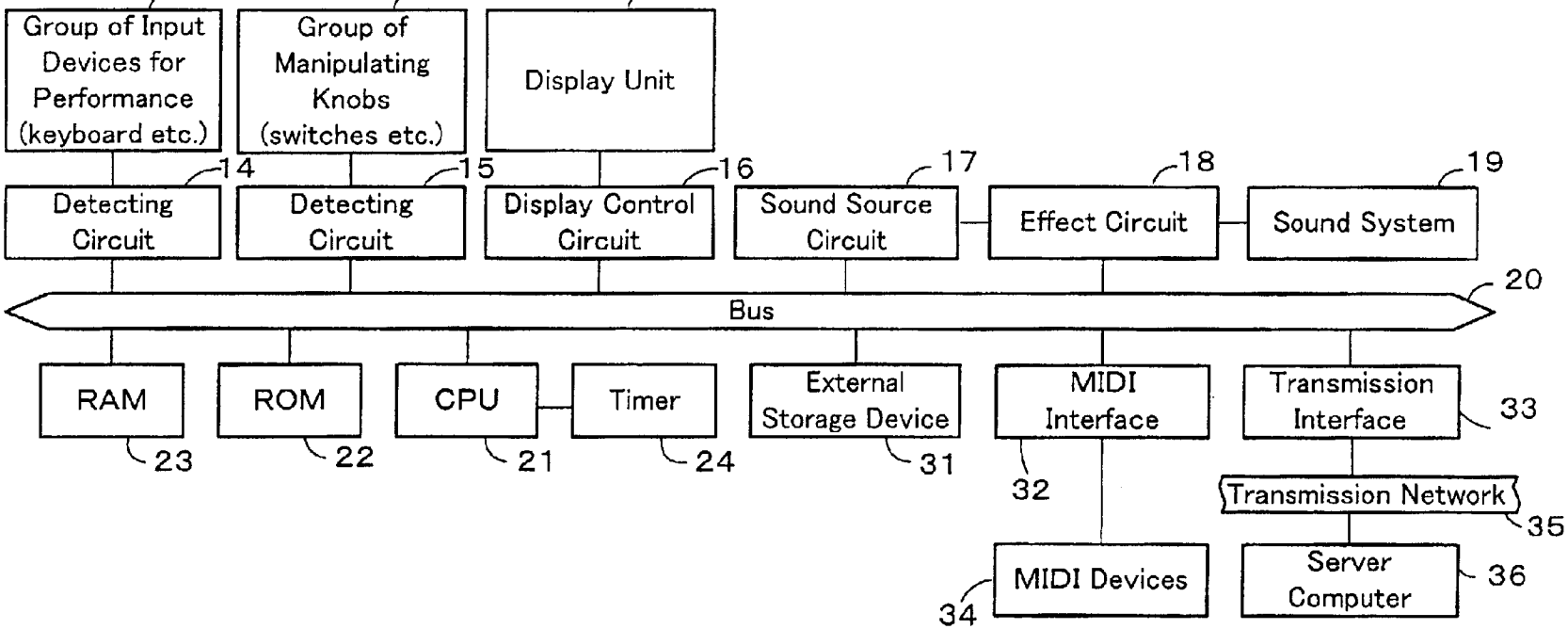
FIG. 1 shows a block diagram of an electronic musical sound generation apparatus as a whole embodiment of this invention.

Other objects and advantages of the present invention will be readily understood by those skilled in the art from the following description of preferred embodiments of the present invention in conjunction with the accompanying drawings of which;

FIG. 1 is a diagram of an electronic musical sound generation apparatus as a whole, including a chord progression correction apparatus and an automatic composition apparatus as an embodiment of this invention.

The musical sound generation apparatus is equipped with Group of Input Devices for Performance 11, Group of Manipulating Knobs 12 and Display Unit 13. Group of Input Devices for Performance 11 is constituted, for example, of a keyboard having a plurality of black and white musical keys, and is operated for performance by a user to indicate generation of musical sound, pitch of generated musical sounds etc. The Group of Manipulating Knobs 12 is disposed on an operation panel and is operated to indicate timbre, volume of generated sounds, displayed content of Display Unit 13, and is used to input necessary data for correction of chord progression and control of automatic composition. Other operating devices such as a set of ten-keys, cursor keys, mouse are included in the Group of Manipulating Knobs 12 in this description. Each operation of these Group of Input Devices for Performance 11 and Group of Manipulating Knobs 12 is detected respectively by Detecting Circuits 14, 15 connected to Bus 20. Display Unit 13, constituted of devices like CRT or LCD, displays various kinds of information in characters and figures, and is controlled by Display Control Circuit 16 connected to Bus 20.

The musical sound generation apparatus has also Sound Source Circuit 17 and Effect Circuit 18, both connected to Bus 20. Sound Source Circuit 17 has a plurality of musical sound signal generation channel to form a musical sound signal based on the performance information (i.e., key code, key-on signal, key-off signal, timber information etc.) furnished from Bus 20, and is capable of generating plural number of musical sound signals simultaneously. Effect Circuit 18 adds various kinds of effect in accordance with effect control parameters received via Bus 20 to the musical sound signals outputted from Sound Source Circuit 17. To this Effect Circuit 18 are connected D/A converter and Sound System 19 comprising amplifiers and loud speakers. The sound processed with effect is then radiated from Sound System 19.

CPU 21, ROM 22 and RAM 23 having a principal role of the micro computer are connected to Bus 20. CPU 21 executes various programs to control the whole musical sound generation apparatus. Timer 24 is connected to CPU 21 to provide CPU21 with necessary timing information for its execution of the various programs. ROM 22 memorizes a part of the programs executed by CPU 21 and a part or all of the data to be utilized for execution of the programs. RAM 23 memorizes temporarily a part of the above mentioned various programs and a part or all of the above mentioned data received during execution of the programs as well as values of the variables necessary for execution of the programs.

To Bus 20 are also connected External Storage Device 31, MIDI (=Musical Instruments Digital Interface) Interface 32 and Transmission Interface 33. External Storage Device 31 consists of data storage medium(s) such as hard disk, flexible disk, CD-ROM, MO (magneto-optical disk), DVD (digital video disk), semi-conductor memory which are either removable from or non-removably embedded to the system and whose memorized content can be read by a computer, and its driving device which enables the storage medium to read and write programs and data. This External Storage Device 31 also memorizes a part of the various programs and a part or all of the above mentioned various data, which are not memorized in ROM 22. Those programs and data memorized in External Storage Device 31 are sometimes directly accessed by CPU 21, but in general, they are once transferred to RAM 23 and then, used at subsequent steps.

MIDI Interface 32 is connected to Other Devices Equipped with MIDI Interface 34 (hereinafter called MIDI Devices 34) such as performance devices like a keyboard, other musical instruments, personal computers, automatic play apparatuses (or sequencers). MIDI Interface 32 functions as an interface when MIDI information is received from and/or sent to MIDI Devices 34.

Transmission Interface 33 is connected to Server Computer 36 via Transmission Network 35 which is in either wired or wireless structure, to receive and/or send data and programs from and/or to Server Computer 36. It is also possible to forward from Server Computer 36 the programs and/or the data to External Storage Device 31 or RAM 23 via Transmission Network 35 and Transmission Interface 33 to utilize them at subsequent steps.

b. Example of Chord Progression Correction Process

Not only describing an example of chord progression correction process which is directly related to the present invention, but a general reason why chord progression correction is desired and what kind of chord progression process is applied to the process of chord progression correction of this invention will now be explained.

Figure 2:
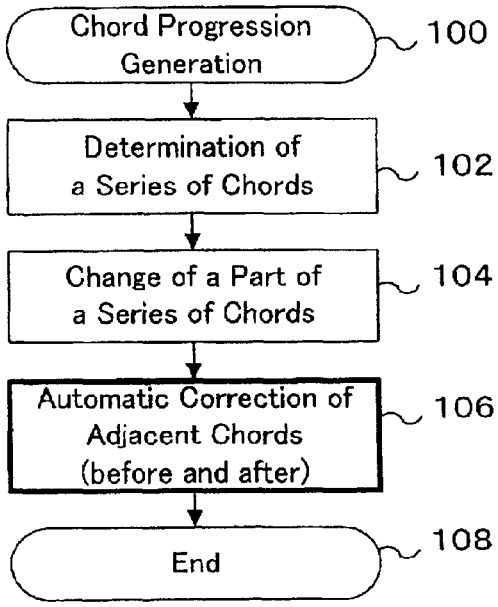
FIG. 2 is a flow chart of a chord progression generation program executed by CPU in FIG. 1 applying the first chord correction method.

When a series of chords is going to be added to a melody performed by a user or automatically played, the user starts up "chord progression generation program" shown in FIG. 2 and memorized in ROM 22 or External Storage Device 31. The execution of this "chord progression generation program" begins at step 100 and a series of chords is determined at step 102.

In the process of determining a series of chords, CPU 21 firstly indicates to select a series of chords by displaying it on Display Unit 13. Then the user, in response, selects a certain series of chords from among plural series of chords prepared beforehand and stored in External Storage Device 31, by operating Group of Manipulating Knobs 12. It is also possible, at the moment of starting up "chord progression generation program", a number of series of chords stored in Eternal Storage Device 31 are forwarded to RAM 23, and the chord series selection is made among the number of series of chords readable from RAM 23. Each series of chords is composed of a plurality of chords which were prepared by following given rules of chord progression, and all of which should bring a musically natural chord connection. In the determining process, the user can use, if he prefers, a sorting function for the chord series selection by designating the desired conditions one by one, for example, major or minor chord, bright or dark impression, etc. to arrive finally at the selected series of chords. During the above mentioned process to input a series of chords, either Group of Input Devices for Performance 11 or Group of Manipulating Knobs 12 can also be utilized instead.

Next, CPU 21 suggests the user, by displaying on Display Unit 13, to change a series of chords step 104, and accepts user's chosen change in a part of the series of chords once determined. In case of adding a series of chords to a melody performed by a user or played automatically, it often happens that the user desires to change a part of the series of chords determined once, namely, the part corresponding to a motif portion and/or other musically highlighted portion in a whole music so that the music may become more attractive. In such case, the user can change the part of the determined series of chords into different chords, insert a new chord among the series of chords, delete a part of the series of chords, or he can copy a part of the series of chords to paste it to another part of the series of chords either by using Group of Input Devices for Performance 11 or by Group of Manipulating Knobs 12.

After such process of step 104, both chords found before and after the changed chord at step 104 are automatically corrected in order to make musical impression at the connection point more favorable, at step 106, and the execution of the "chord progression generation program" terminates at step 108. As the process at step 106 is directly related to this invention, it will later be described again in detail. Through the execution of such chord progression generation program", a series of chords is finally determined.

In the next paragraph, an explanation will be given to the case when the chord progression correction related to this invention is applied to an automatic composition apparatus which composes automatically musical melodies. At first, the user starts up the automatic composition program of FIG. 3 stored in ROM 22 or External Storage Device 31. The execution of this "automatic composition program" begins at step 120 and necessary data for melody generation are inputted at step 122.

In the process of inputting the data for melody generation, CPU 21 displays the indication of melody generation data input on Display Unit 13. Then a user, in response, inputs data for melody generation by operating Group of Input Devices for Performance 11 or by Group of Manipulating Knobs 12. The data for melody generation comprise parameters corresponding to musical nuance, music key, motif melody, music structure (=combination of plural musical paragraphs), pitch information (=register, pitch fluctuation etc.), rhythm information (=number of notes, syncopation etc.) etc.

Then, CPU 21 executes chord progression generation process at step 124. The chord progression generation process is almost identical to the "chord progression generation program" in FIG. 2 except a part of steps 102 and 104. Namely, at step 102, it is possible, in addition to the above mentioned process, to determine a series of chords by using some of the parameters such as musical nuance, music key, motif melody, music structure which are inputted at step 122. This is especially an efficient way when a series of chords should be selected from among a number of series of chords stored in External Storage Device 31.

At the process of step 104, it is possible to change automatically a part of the determined series of chords by the melody generation data inputted at step 122, either in addition to or instead of the chord change process by either Group of Input Devices for Performance 11 or Group of Manipulating Knobs 12. For example, the most adequate chord (or chord progression) to the motif melody can be detected based on the motif melody itself inputted at step 122. Then, the detected chord is inserted into a proper position in the determined (at step 102) series of chords, or it replaces a certain chord existing there.

After the process at step 124, one suitable musical scale mode is detected at step 126 among various kinds of musical scale mode, such as Ionian mode, Lydian mode, Mixolydian mode, Dorian mode based on the determined series of chords at step 124. The musical scale mode is selected according to the kind of chords constituting the determined series of chords, because the kind of chord is limited in accordance with the specialized musical scale mode. As this musical scale mode detection is not essentially related to this invention, further explanation is abbreviated here.

At the next step 128, a melody is generated automatically, then execution of the "automatic composition program" is terminated at step 130. A melody is composed automatically, based on the inputted data for melody generation, the determined series of chords and the detected musical scale mode. As the automatic composition itself is not directly related to chord progression correction of this invention, detailed description is here abbreviated.

C. The First Chord Correction Method

In this paragraph, the first way of chord correction will be explained in detail. This is applied to the case when a chord is changed either manually or automatically according to the motif portion of a music as described in the above. The chords placed before and after the changed chord are corrected automatically by the process of step 106 in FIG. 2.

Figure 4:
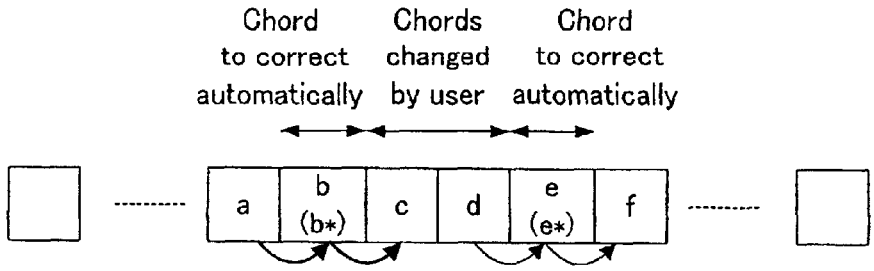
FIG. 4 shows a diagram of a series of chords to explain the way of the first chord correction.

FIG. 4 shows an example of the series of chords determined at the above mentioned step 102 in a form of " . . . , a, b, c, d, e, f., . . . ". The chords "c" and "d" are the ones changed either manually or automatically at step 104. The chords located before the chord "a" and after the chord "f" remain unchanged from the one in the series of given chord, and the chord "b" and "e" are the ones to be corrected automatically into "b*" and "e*" respectively. Namely, the chord "b" is corrected into "b*" which has a musically natural connection with both chord "a" and chord "c", and the chord "e" is corrected into "e*" which has a musically natural connection with both chords "d" and "f".

Each of the above mentioned chords "a", "b", "c", "d", "e", "f" expresses a kind of chord and it is not necessary for each one to have a constant length (i.e., number of measures, beats). For instance, a measure can fully be occupied by one chord "e", or two earlier beats of a measure can be occupied by "e" and the rest by "f".

c1. Determination of the Correction Chord "e*"

An example of correction process of the chord "e" is herein below described. The changed chords "c" and "d" belong to a motif portion of the music, and this motif portion is generally placed at the melody part "A" and/or the melody part "B", namely at the head of a block. Accordingly, as the chord "d" cannot be musical punctuation due to its position enough close to the head position, the chord connection between the chords "d" and "e" can be made despite the ending impression. Each of the melody parts A and B signifies one musical paragraph among a plurality of paragraphs which constitutes a music.

The detailed procedure of the process in step 106, will be described hereafter.

<Procedure 1>

The progression of the series of chords determined at the process of step 102 in FIG. 2 is analyzed to detect its feature automatically. The feature can be recognized by such expressions as "the chord consists uniquely of diatonic chord (=a chord constituted of plural notes selected from among seven notes in diatonic scale)", "the chord consists only of triad (=chord constituted of three notes)". When the feature of the series of chords is already inputted by making use of sorting function at the step 102 to determine the series of chords, it is recommended to use the inputted feature of the series of chords, instead of the detection of the feature of the series of chords, or in addition to the detected feature of the series of chords.

<Procedure 2>

The chord "e*" is determined, referring Table 1 shown below, so that both chord connections from "d" to "e*" and from "e*" to "f" may be musically natural. The chord progressions in Table 1 are expressed by the interval between two roots of a pair of chords and by the direction of progression between two roots. For instance, "+4th perfect", "−2nd minor", and "−2nd major" signify "root will go up 4th perfect intervals", "root will go down 2nd minor intervals" and "root will go down 2nd major intervals" respectively. Chord progressions shown in the tables cited afterwards are expressed also by the interval between two roots and by the chord change direction. Such data in the tables are stored in External Storage Device 31 in a table format. In Table 1, if the chord "e*" exists in both columns of priority 1, all such "e*" chords are listed up as candidate to be selected. If there is no "e*" in any columns of priority 1, columns of priority 2, 3, etc., shall be searched, in order to find out next candidates to be eventually listed up.

TABLE 1

| Priority | Progression "d"–"e*" | Progression "e*"–"f" |
|---|---|---|
| 1 | +4th perfect | − 2nd minor, −2nd major |
| | −2nd minor, −2nd major | + 4th perfect |
| | +4th perfect | −3rd minor, −3rd major, +3rd minor |
| | −3rd minor, −3rd major, +3rd minor | +4th perfect |
| | 4th augmented("d" is 7th dim.) | +4th perfect |
| | +2nd major | +2nd major |
| | +2nd minor | +2nd minor |
| | +3rd major | +3rd major |
| | +3rd minor | +3rd minor |
| 2 | −3rd minor, −3rd major, +5th perfect | −2nd minor, −2nd major, +5th perfect |
| | −2nd minor, −2nd major, +5th perfect | −3rd minor, −3rd major, +5th perfect |
| . | . | . |
| . | . | . |
| . | . | . |

<Procedure 3>

If the chords listed up in the above way includes the chord "e" which was determined at the process of step 102, the chord "e" is replaced by the correction chord "e*". If the chord "e" is not found in the list, the correction chord "e*" is selected from among the listed chords by finding the one which satisfies the features detected in the procedure 1. If there are plural chords satisfying the conditions, one chord can be selected from among them as the correction chord "e*", at random or by the user's any idea.

<Procedure 4>

In case when the chord "d" is a special (relatively unusual, e.g., diminish chord "dim"), neither way of chord selection described in Procedure 1 nor 2 should be adopted. The correction chord "e*" is determined according to priority shown in the following Table 2.

TABLE 2

| Priority | Progression "d"–"e*" | Progression "e*"–"f" |
|---|---|---|
| 1 | +2nd minor | +2nd minor, −2nd minor |
| 2 | −2nd minor | +2nd minor, −2nd minor |
| . | . | . |
| . | . | . |
| . | . | . |

<Procedure 5>

The determined chord "e" in a series of chords is replaced by the correction chord "e*" determined according to either procedure 3 or 4.

c2. Determination of the Correction Chord "b*"

The chord "b" is at the end of the block located before the changed chords "c" and "d". Consequently, in order to determine not only the chord progression, from the chord "a" to the chord "b", including the chord "b" which is to be corrected, but also another chord progression from the chord "b" to the chord "c", it is necessary to consider a required condition for musical ending impression in addition to the conditions taken for determination of the chord "e".

The detailed procedure of the process during step 106, will be described below.

<Procedure 1>

Just as the case of the chord "e" determination, the features of the determined series of chords are detected.

<Procedure 2>

The chord "b*" is determined by referring to Table 3 shown below, so that both chord connections from "a" to "b*" and from "b*" to "c" maybe musically natural, giving a musical ending impression. The chord progressions in Table 3 are expressed by the same way as in Table 1, but the priority is determined considering the ending impression that each chord progression brings. The way of referring and utilizing Table 3 is also the same as the case of Procedure 2 for determination of the chord "e*

TABLE 3

| Priority | Progression "a"–"b*" | Progression "b*"–"c" |
|---|---|---|
| 1 | +4th perfect<br>−2nd minor, −2nd major | − 2nd minor, −2nd major<br>+ 4th perfect |
| 2 | +4th perfect<br>−3rd minor, −3rd major, +3rd minor | −3rd minor, −3rd major, +3rd minor<br>+4th perfect |
| 3 | +4th augmented( "a" is 7th dim.) | +4th perfect |
| 4 | +2nd major<br>+2nd minor | +2nd major<br>+2nd minor |
| 5 | +3rd major<br>+3rd minor | +3rd major<br>+3rd minor |
| 6 | −3rd minor, −3rd major, +5th perfect<br>−2nd minor, −2nd major, +5th perfect | −2nd minor, −2nd major, +5th perfect<br>−3rd minor, −3rd major, +5th perfect |
| . | . | . |
| . | . | . |
| . | . | . |

<Procedure 3>

A similar procedure as the case of the chord "e*" determination is adopted. If, in the chords listed up in the procedure 2, is included the chord "b" which was determined by the process of step 102, the chord "b" is replaced by the correction chord "b*". If the chord "b" is not found in the list, the correction chord "b*" is selected from among the listed chords by finding the one satisfying the features detected in the procedure 1. When there are plural chords satisfying such conditions, one chord can be selected from among them as the correction chord "b*", at random or by the user's any idea.

<Procedure 4>

In case when the chord "a" is a special (relatively unusual, e.g., diminish chord "dim"), neither way of chord selection described in Procedure 2 nor 3 should be adopted. The correction chord "b*" is then determined according to priority shown in the following Table 4, although Table 4 contains only one category of priority.

TABLE 4

| Priority | Progression "a"–"b*" | Progression "b*"–"c" |
|---|---|---|
| 1 | any progression | +2nd minor |

<Procedure 5>

The determined chord "b" in a series of chords is then replaced by the correction chord "b*" determined in the procedure either 3 or 4.

c3. A concrete Example of the Chords "e" and "b" Correction Procedure

Figure 5:
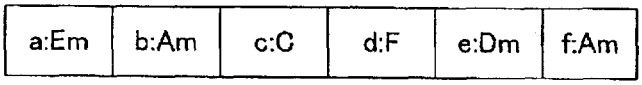
FIG. 5 shows an example of the series of chords in FIG. 4.

Taking an example as shown in FIG. 5, where a part of a series of chords "a", "b", "c", "d", "e" and "f" assigns respectively E minor (Em), A minor (Am), C major (C), F major (F), D minor (Dm) and A minor (Am), the concrete procedure of correcting the chords "e" and "b" will herein below be explained in detail.

The chords "a, "b", "e" and "f" are a part of the set of chord determined by the process of step 102, while the chords "c" and "d" are the ones changed by the process of step 104 reflecting features of the motif portion etc. Two detected features of the series of chords by the procedure 1 are supposed to be "uniquely diatonic chord" and "triad chord only". The inputted "key" at step 122 is C major.

The correction procedure of the chord "e" is as follows. Since the chords at both before and after the chord "e" (Dm) are "d" (F) and "f" (Am), the following chords, G major (G), G minor (Gm), G seventh (G7) and G minor seventh (Gm7) are listed up as candidates to become the chord "e*", by referring Table 1 in the procedure 2, under the condition that "each interval of the roots in the progressions "d"-"e*" and "e*"-"f" are in the relationship of "+2nd major" and "+2nd major", respectively. These chords, G. Gm,G7 and Gm7 are found with the priority 1 of Table 1. In this case, because the chord "e"(Dm) is not included in the listed up chords, G major (G) is nominated and picked up, in the procedure 3, to become the correction chord "e*", according to the conditions, "uniquely diatonic chord" and "triad chord only", detected in the procedure 1. Before the chord "e", the chord "d" which is F major (F) is placed, and as it does not belong to the special chord group shown in Table 2, the chord indication in the procedure 4 is not applied. The chord "e"(Dm) in the series of chords is thus changed into the correction chord "e*"(G) by the procedure 5, as a result.

Now comes the explanation about the correction of the chord "b". The adjacent chords before and after the chord "b" (Am) are "a" (Em) and "c" (C). Subsequently, based on Table 3, two following groups of candidates for the chord "b*" are listed up. The first group contains G major (G), G minor (Gm), G 7th (G7) and G minor 7th (Gm7), satisfying the condition that "each interval of the roots in the progressions "a"-"b*" and "b*"-"c" are in the relationship of "+3rd minor" and "+4th perfect", respectively. The second group contains A major (A), A minor (Am), A 7th (A7) and A minor 7th (Am7), satisfying the condition that "each interval of the roots in the progressions "a"-"b*" and "b*"-"c" are in the relationship of "+4th perfect" and "+3rd minor", respectively. These listed chords, G, Gm, G7, Gm7, A, Am, A7 and Am7, correspond to the priority 2 in Table 3. In this case, because the chord "b"(Am) is included in the listed up chords, this A minor (Am) is nominated and picked up, in the procedure 3, to become the correction chord "b". Before the chord "b", the chord "a" which is E minor (Em), is placed, and as it does not belong to the special chord group shown in Table 4, the chord indication in the procedure 4 is not applied. As a result, the chord "b"(Am) in the series of chords rests as it was, even after the execution of the procedure 5.

As described in the above, in the first method of chord correction, the system changes a part of a series of chords, in order that the chords "b" and "e" adjacent to the changed chord "c" and "d" have a musically natural connection with the changed chord, that is the adjacent chords "b" and "e" are changed into the correction chords "b*" and "e*" respectively. Accordingly, by applying this first method of chord correction to various systems such as an automatic composition system which requires to change a part of a series of given chords, it becomes possible to supply automatically in a relatively easier way a series of chords which brings to the music more musically natural impression.

c4. Examples of Variations

In the above described example of the first method of chord correction, the chord correction was brought to each one of the chords, "b" and "e", located at both sides of the changed chords "c" and "d". However, it is possible to extend the correction to the chords "a" and "b" and/or the chords "e" and "f". In such case, a extended table is prepared, at first, which is used to realize a musically natural chord connection not only with the precedent chord but also with the following chord. Then, by referring this table repetitively, plural chords with priority information are listed up for each one of the chords to be changed. A series of chords having the highest priority can finally be selected from among the listed sets of chords. It is also possible to prepare a table storing a number of series of chords which were already confirmed to realize a musically natural connection, and then to extract a suitable series of chords.

In case when an adequate chord is detected based on given motif melody, a more natural musical connection can be obtained by selecting over again a series of chords corresponding to a chord progression suitable for the detected chords "c" and "d". For instance, if the conditions "uniquely diatonic chord" or "triad chord only" are detected based on a motif melody and the series of chords selected already does not suit to these conditions, a new series of chords satisfying "uniquely diatonic chord" and "triad chord only" is then searched and selected over again. The way of search and selection may be sorting each chord's features registered beforehand such as "uniquely diatonic chord", "triad chord only", or could be evaluating chord progression of each series of chords to extract its peculiar features such as "uniquely diatonic chord", "triad chord only" and to select eventually a proper one.

In the above mentioned example of the first chord correction, the chords "b" and "e" which are placed before and after the changed chords "c" and "d", were replaced by the correction chords "b*" and "e*". But it is also possible to shorten the length of the chords "b" and "e" and insert the correction chords at the portion adjacent to the changed chords "c" and "d". In other words, when a determined series of chords consists of plural chords "a", "c", "d" and "f" which contain neither the chord "b" nor "e", and the chords "c" and "d" were changed according to a motif portion, the latter portion of the chord "a" can be replaced by the mentioned correction chord "b*", and the earlier portion of the chord "f" can be replaced by the mentioned correction chord "e*".

Another possibility exists in the way where, in the example of the above mentioned series of chords "a", "b", "c", "d", "e" and "f" (the chords "c" and "d" were changed according to a motif portion), a chord having the determined length (e.g., one measure length) is inserted between the chord "b" and "c" as well as "d" and "e" without changing the portions before the chord "b" and after the chord "e", and the inserted chord can be modified so that it may have a musically natural connection with its adjacent chords.

A user can also select a preferred way from among the first chord correction method, and various variations of chord correction described in the above.

Additionally, although any concrete explanation was abbreviated on the range of chord change and on chord range of the motif portion, such range can be any number of measures, and the number of chords within one measure is not limited.

d. The Second Chord Correction Method

In this paragraph, the second method of chord correction will be described.

This second method is to be applied to a system which generates a melody by an inputted motif melody. The chord corresponding to the motif portion among the determined series of chords is replaced by a chord which is more suitable to the motif melody and has a musically natural connection with its adjacent chords.

Figure 6:
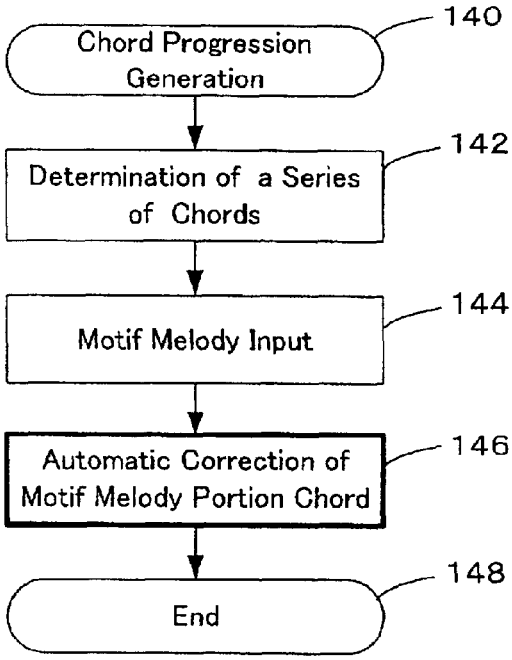
FIG. 6 is a flow chart of a chord progression generation program executed by CPU in FIG. 1, applying the second chord correction method.

For this sake, the user starts up the "chord progression generation program" of FIG. 6 stored in ROM 22 or External Storage Device 31, instead of the chord progression generation program" of FIG. 2.

The execution of chord progression generation program begins at step 140, and a series of chord is determined at step 142 just as in the case of the program in FIG. 2. At step 144, CPU 21 displays indication of inputting motif melody on Display Device 13, according to which the user inputs a motif melody and the part corresponding to the motif melody in the series of chords by operating Group of Input Devices for Performance 11 and Group of Manipulating Knobs 12.

After the process of step 144, CPU 21 automatically corrects the part corresponding to the motif melody in the series of chords to bring a better chord connection at step 146, and finishes execution of the "chord progression generation program" at step 148.

Because the process of step 146 is directly related to this invention, it will be explained afterwards in detail, as "second chord correction method". The final chord set is thus determined by the execution of such "chord progression generation program".

Figure 3:
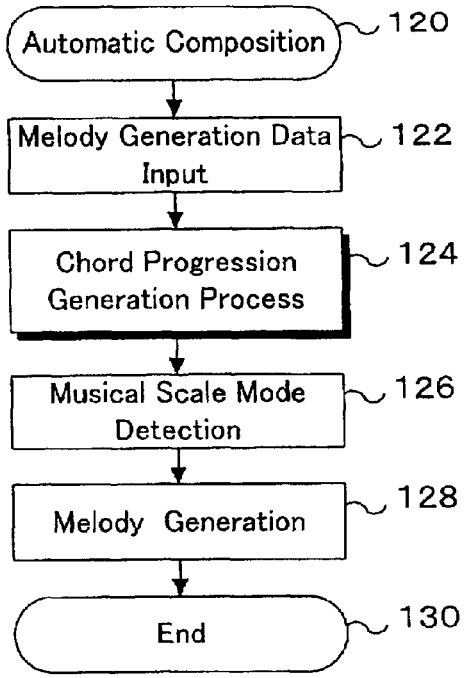
FIG. 3 is a flow chart of an automatic composition program executed by CPU in FIG. 1 applying the first chord correction method.

When the second chord progression correction method is applied to an automatic composition apparatus which composes melodies automatically, the "automatic composition program" shown in FIG. 3 is executed. In this case, "chord progression generation program" of FIG. 6 is applied to the process of chord progression generation at step 124 in FIG. 3. It is not necessary to input information on the motif melody to the "chord progression generation program" at step 122, as the data inputted at step 144 in FIG. 6 can be utilized here.

Next, the procedures of automatic correction of chords for the motif melody part will be herein below explained in detail.

Figures 7, 8:
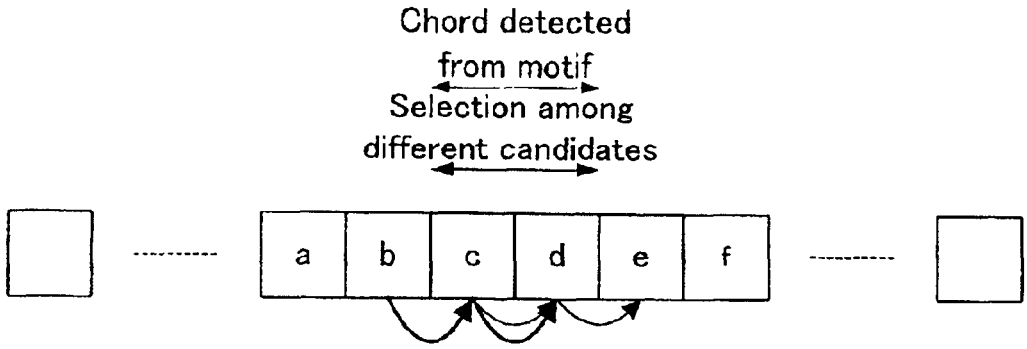
FIG. 7 shows a diagram of a series of chords to explain the way of the second chord correction.
FIG. 8 shows an example of the series of chords in FIG. 7.

FIG. 7 shows a series of chords . . . , "a", "b", "c", "d", "e", "f" . . . determined through the process of step 142 just as the case of the first chord correction method, where the chords "c" and "d" correspond to the motif melody part inputted at the process of the step 144. Each chord expressed by "a", "b", "c", "d", "e" or "f" means one kind of chord whose length (e.g., number of measures or beats) is not necessarily constant.

<Procedure 1>

Just as in the case of the first chord correction method, the progression of the series of chords determined at the process of step 142 is analyzed to detect its feature automatically in the similar way of the first chord correction method.

<Procedure 2>

Based on the motif melody inputted at the process of step 144, plural chord sets "c" and "d" (corresponding to the chords "c" and "d") are listed up as candidates of the chord progression suitable for the melody. In this case, at least one note of notes which constitute each chord of the listed up chords is coincident with at least one note included in the motif melody, and each of the listed chords should bring a musically natural connection in the whole series of chords.

<Procedure 3>

Among the listed up chords, only the chord sets "c'" and "d'" which satisfy the feature detected in Procedure 1 are selected. The number of the listed up chord sets are thus shaken off, by which only the chords satisfying the condition, for example, "diatonic chord" and "triad chord", can remain as candidate.

<Procedure 4>

Referring Tables 5 and 6 below, both the correction chord "c*" which brings a musically natural connection with the precedent chord "b" and the correction chord "d*" which brings a musically natural connection with the following chord "e" are determined from among the already selected chord sets "c'" and "d'" in the procedure 3. Tables 5 and 6 are made from the data stored in External Storage Device 31 in the form of table. The data in Table 5 show evaluated values of naturalness of the progression from the chord "b" to the chord "c*", while those in Table 6 show evaluated values of naturalness of the progression from the chord "d*" to the chord "e". The chord progressions in Table 5 and 6 are expressed by the interval between two roots of a pair of chords and by the direction of progression between two roots. For instance, "−2nd major", "+2nd major" and "−3rd minor" signify "root will go down 2nd major intervals", "root will go up 2nd major intervals" and "root will go down 3rd minor intervals" respectively.

TABLE 5

| Evaluated value | Progression "b"–"c'" ("b"–"c*") |
|---|---|
| 4 | −2nd minor, +2nd minor, + 4th perfect |
| 3 | −3rd minor, + 3rd major, −3rd minor |
| . | . |
| . | . |
| . | . |

TABLE 6

| Evaluated value | Progression "d'"–"e" ("d*"–"e") |
|---|---|
| 4 | −2nd major, −3rd major, −3rd minor |
| 3 | −2nd minor, +2nd major, +5th perfect |
| . | . |
| . | . |
| . | . |

The steps to determine the correction chords "c*" and "d*" may be more concretely described as follows.

Each of the chord sets selected in the procedure 3 is handled one by one, in order. The progression from the chord "b" designated from among the series of chords at the process of step 142, to the chord "c'" (corresponding to the chord "c*") which is an earlier-coming part of the selected two chord sets "c" and "d'", is evaluated from the viewpoint of musical naturalness in connection portion. The evaluation can be executed by referring Table 5 for the two roots, "b"–"c'". On the other hand, the progression from the chord "d'"(corresponding to the chord "d*") which is an later-coming part of the selected two chord sets "c" and "d'", to the chord "e" designated from among the series of chords determined at the process of step 142, is similarly evaluated. The evaluation can be made by referring Table 6 for the two roots, "d'"-"e'". The two evaluated values are summed to be temporarily memorized. Then, among plural chords sets selected in the procedure 3, the chord sets "c'" and "d'" having the largest summed value are determined to be adopted as the correction chord sets "c*" and "d*" by referring Tables 5 and 6. If there are plural chord sets having the same largest summed value, the user can choose one of them at random, or determine it by his any preference.

<Procedure 5>

When the chord "b" and/or "e" is one of the special chords (e.g., diminish chord), the above mentioned way of chord set selection in Procedure 3 and 4 should not be adopted, but the evaluation values placed in Tables 7 and 8 shown below are available. Tables 7 and 8 are also made from the data stored in External Storage Device 31 in the form of table. The data in Table 7 show evaluated values of naturalness of the progression from the chord "b" to the chord "c*" when the chord "b" is one of the special kinds of chord, while those in Table 8 show evaluated values of naturalness of the progression from the chord "d*" to the chord "e" when the chord "e" is one of the special kinds of chord. Just as the case of Tables 5 and 6, the chord progressions in Table 7 and 8 are expressed by the interval between two roots of a pair of chords and by the direction of progression between two roots.

TABLE 7

| Evaluated value | Progression "b"–"c'" ("b"–"c*") |
|---|---|
| 4 | $+2^{nd}$ minor |
| 3 | $-2^{nd}$ minor |
| . | . |
| . | . |
| . | . |

TABLE 8

| Evaluated value | Progression "d'"–"e" ("d*"–"e") |
|---|---|
| 4 | +2nd minor |
| 3 | +2nd major |
| . | . |
| . | . |
| . | . |

The determining steps of the evaluated value will be more concretely described herein below.

If the chord "b" in the series of chords determined at step 142 is one of the special kind of chords, an evaluated value corresponding to the chord progression "b"-"c" is taken from Table 7. If the chord "e" in the chord set is one of the special kinds of chords, an evaluated value corresponding to the chord progression "d'"–"e" is taken from Table 8. Then, the determination of the chord sets "c*" and "d*" is made after summing the two values according to the described procedure 4.

This paragraph will explain the process of chord correction in the procedures 1–5 by citing a practical example, where two chords "b" and "e" among the chords, "a", "b", "c", "d", "e", "f" which are a part of the series of chords determined at the process of step 142, are "B minor 7th flat 5" (Bm7b5) and "A minor" (Am) respectively, and the chords "c" and "d" are to be corrected. The chords "c" and "d" are the part corresponding to the motif melody. Each of them occupies one measure, and the two chords cover two measures. As motif melody, two chords "E" and "G" are given to the first measure and "A", "G" to the second measure. The key inputted at the process of step 122 is C major.

The feature of the series of chords detected by the procedure 1 is "uniquely diatonic chord", and 7(seven) chord sets "Am7"-"Dm7", "Em"-"C6", "C7"-"F", "G6"-"Am", "C"-"F", "Em"-"D7" and "A7"-"Dm7" are selected as candidate for the correction chord sets "c*"-"d*" determined by the motif melody in the procedure 2. Then, they are shaken off in the procedure 3 according to the feature of the chord "uniquely diatonic chord", and four chord sets, "Am7"-"Dm7", "Em"-"C6", "G6"-"Am" and "C"-"F" are picked up.

In the procedure 4, the chord connection from the chord "b" (Bm7b5) to chords at the first measure in each of the four chord sets, "Am7", "Em", "G6" and "C" respectively, are evaluated. The evaluated values are 4, 4, 3 and 0 respectively, because intervals between two roots of each chord progression are <−2nd major>, <+4th perfect>, <−3rd major> and <+2nd minor> respectively. On the other hand, since the chord of the second measure in each of the four chord sets are "Dm7", "C6", "Am" and "F", the evaluated values from each of them to the chord "e" (Am) are 3, 4, 0 and 0 respectively, because intervals between two roots of each chord progression are <+5th perfect>, <−3rd minor>, <1(the same)> and <+3rd major> respectively. The evaluated value "0" is given to the chord connections which are not found in Tables 5 and 6.

Four sets of evaluated values for the four chord sets "Am7"-"Dm7", "Em"-"C6", "G6"-"Am" and "C"-"F" are then summed respectively. The result is 7,8,3 and 0 respectively. Consequently, the chord set "Em"-"C6" corresponding to the maximum value 8 is finally chosen as the correction chord set "c*"-"d*". In this example. Since any special chord (like diminish chord) is not found in the chord "b" or "e", it is unnecessary to refer Table 7 or 8 in the procedure 5.

If viewed briefly, the second chord correction method comprises the following steps. For a system in which a motif melody is given to a series of given chords, the chord sets "c*" and "d*" which are appropriate to the motif melody and have a musically natural connection with the adjacent chords are firstly determined. Then, the chords "c" and "d" corresponding to the motif melody are replaced by the determined chord sets "c*" and "d*". Accordingly, in an automatic composition system and the like, it becomes relatively easy to obtain a musically natural series of chords by using the second chord correction method.

In the described case, the chord set corresponding to a motif melody was constituted of two chords, but this second chord correction method is also applicable to cases when the chord set is constituted of one or more than two chords. In case of one chord, the connection between the one chord and its adjacent chords in the determined chord set is evaluated in the above explained way. While, in case of three chords, two connections, between each one of two chords located at extremities of the three chords and its respective adjacent chord in the determined chord set, are evaluated in the same way.

In the described second chord correction method, the chord set is determined by reason of having the maximal summed value. However, if the summed value does not attain the predetermined value, determination of the series of chords can be exercised over again, or the chords, adjacent to the part corresponding to the motif melody among the determined series of chords, can be corrected also following the first chord correction method.

In the second chord correction method, the chord connections at two extremities of the chord set corresponding to the motif melody were considered, but, in case when a motif portion comes at the extremity of the music, e.g., at the top of music, it is not necessary to take the chord connection at the concerned point into account.

e. Application of Chord Correction to Automatic Composition

A music is generally composed so that each of its sections may have original musicality as well as have ups and downs as a whole. In the following paragraph, the term "musical highlight (="musically highlighted portion" utilized already in this document)" regarding the original musicality will be described to clarify its definition.

The "musical highlight" means "a portion of music whose musical expression is more original and different from other portions". It includes, for instance, a portion of climax, a portion of depression, and a modest portion to make intentionally a climax or a depression more outstanding. It would be possible to utilize some other term than the "musical highlight" for a musical section with said original musicality. Moreover, various kinds of terms can be assigned to a plurality of musical sections having their respective and different musical originalities. In other words, the portion of "musical highlight" can also be defined as "an especially marked section of a music".

In the embodiment described in the following, the term "musical highlight" is adopted to express, as an example, a portion of climax or uprush in a music, and not other original musicalities. In order to utilize the portion of "musical highlight" (section having a special original musicality) widely in composition process, it is copied to put it at the beginning of the music (music of "musical highlight"-beginning), to put it at the end of music (music of "musical highlight"-ending), or to repeat it plural times at the end of music (music of repetitive-"music highlight"-ending). In this example, the first and second chord correction method above described are adapted to an automatic composition system which composes a music comprising the "musical highlight".

Figure 9:
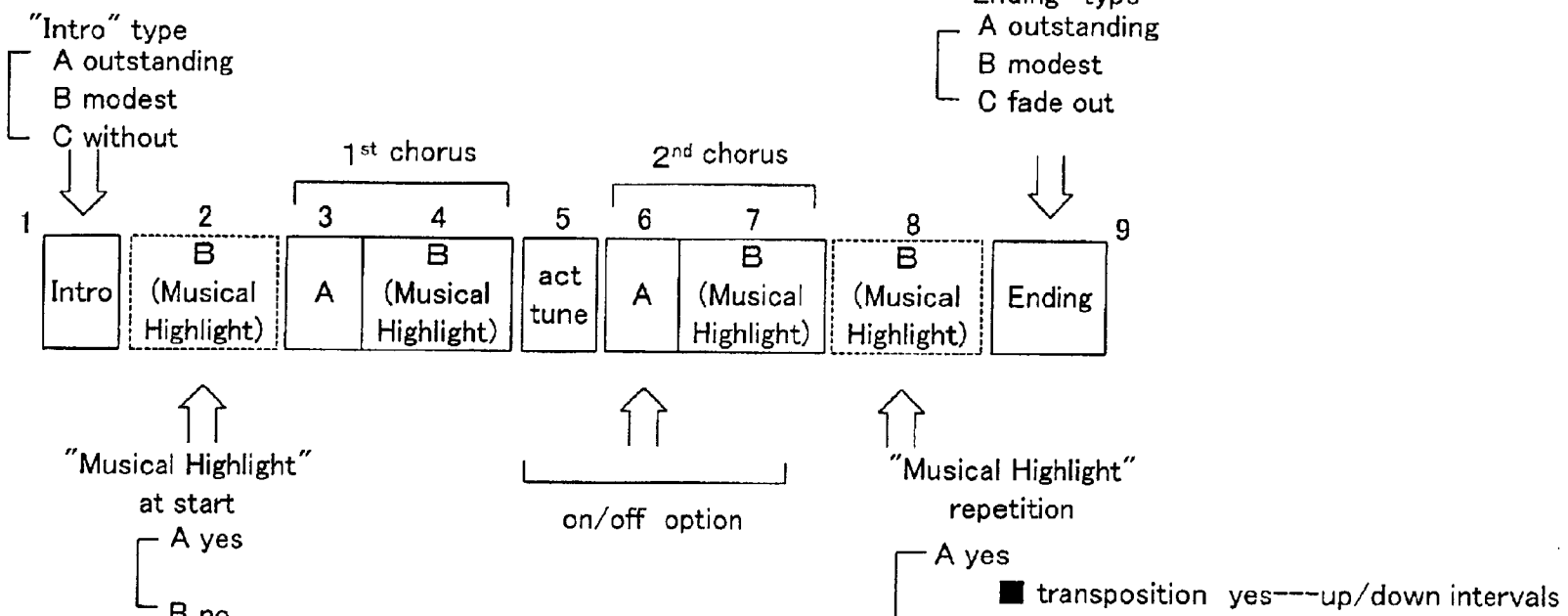
FIG. 9 shows an example of music piece containing musically highlighted portions.

In FIG. 9, is shown an example of determination process of music structure in an automatic composition system. At "Intro 1" and "Ending 9", a user can choose one preferred type among plural candidates. For instance, outstanding type accompaniment or modest type accompaniment can be chosen at beginning and/or ending of a music to be composed. Sections 3, 4 and 6, 7 signify the principal portion of a music, usually called "first chorus" and "second chorus" respectively. If the second chorus is unnecessary, user can delete the section.

The section called here "musical highlight" generally comes after the early appearing part of the principal portion (at each section of B in FIG. 9). In order to make use of the "musical highlight" in a music, the following way of music structure determination can be taken.

In the first way, the "musical highlight" comes at the beginning to give a climax of music at its starting moment, while in the second way it comes at the ending to end the music with a climax. In the third way, the "musical highlight" is repeatedly used in a music. FIG. 9 shows a case where both the second and the third ways are adopted, namely, repeating the "musical highlight" during and at the end of a music. Sometimes, a transposed "music highlight"

is repeated to give a dramatic effect to the music. When "fade out" is indicated at ending portion, the music ends with repeated its ending portion but fading out gradually. In this case, if "repetition of musical highlight" is indicated, the music ends with repeated "musical highlight" fading out.

Figure 10:
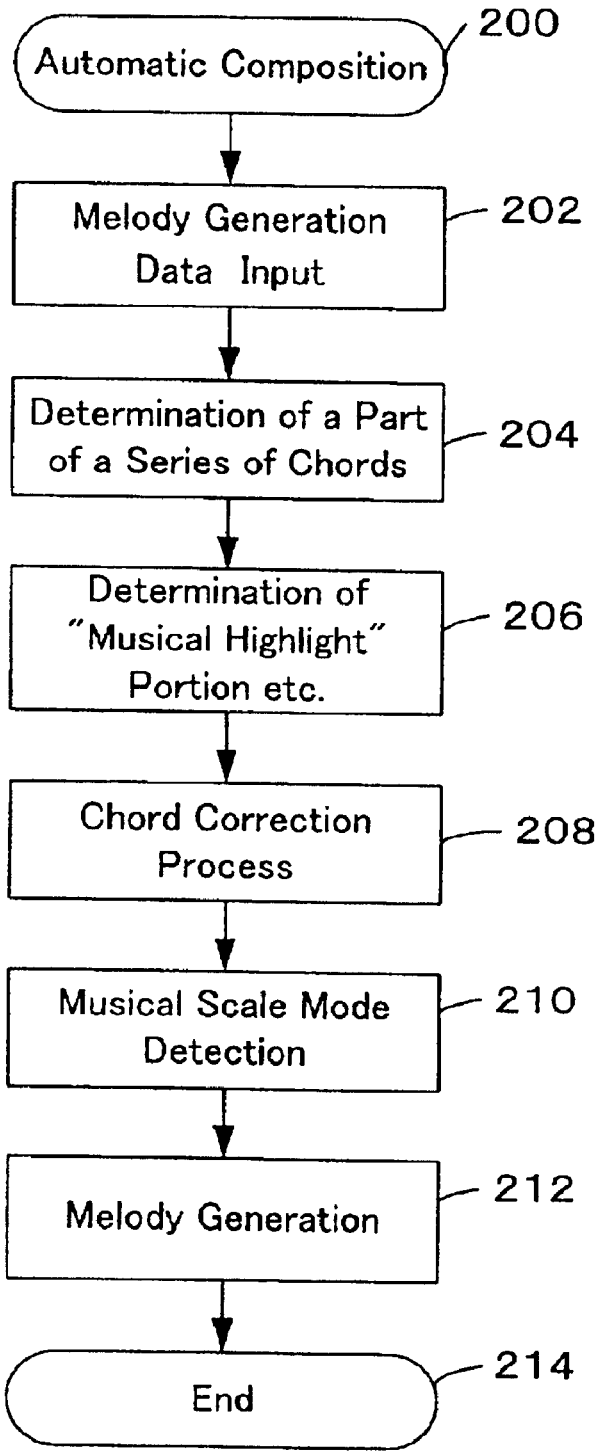
FIG. 10 is a flow chart of another automatic composition program executed by CPU in FIG. 1, applying the first and the second chord correction method; and, FIG. 11 is an example of displayed information according to the automatic composition program of FIG. 10.

Next, an automatic composition system which applies the above described method will be explained. This automatic composition system is constructed as shown in FIG. 1, whose principal function is controlled by a micro-computer. An automatic composition program shown in FIG. 10 is stored in ROM 22 or External Storage Device 31 to be executed by CPU 21.

The execution of the program is started up at step 200. After starting up the program, just as the process of step 122 of FIG. 3, the data for melody generation are inputted at step 202. To generate a part of the "musical highlight" in a music which is going to be composed, are inputted such melody generation data as melody data for the "musical highlight", data indicating the position of the "musical highlight" in the music, pitch data enabling the pitch at the "musical highlight" higher than other portions in the music so that the "musical highlight" may become still more impressive. Thus, besides the basic melody generation data for portions of 1st chorus melodies A, B, act tune, 2nd chorus melodies A,B etc., additional melody generation data which indicate that the melody portion B is "musical highlight" portion are given, as shown in 3–5 in FIG. 9.

At step 204, a series of chords is inputted just as the process of step 102. In this case, however, chord progressions with many tension chords are adopted to the part corresponding to the "musical highlight" so that its accompaniment may be showy.

Figure 11:
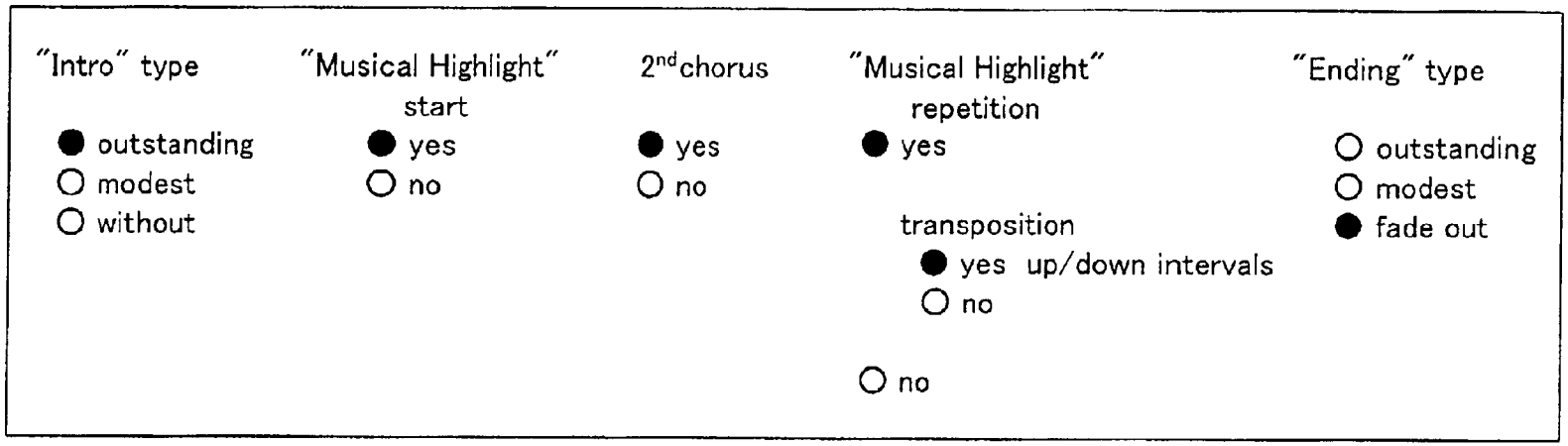

After processing at steps 202 and 204, CPU 21 displays on Display Device 13 a message requesting the user to indicate a section which should include a "musical highlight" at step 206. An example of such displayed message is seen in FIG. 11. The displayed message inquires the user whether the "Intro" section should be outstanding type, modest type, or it should be eliminated. It asks also whether the melody portion of the 2nd should remain or be deleted, whether the "musical highlight" be at the beginning, or be repeated, whether the repeated "musical highlight" should be transposed (and to which music key, if yes), whether the ending section should be outstanding or modest, and whether the ending should be faded out or not.

By answering to each of such inquiries, the user designates, by handling Group of Manipulating Knobs 12, the appropriate sections which constitute a complete music. For instance, if the black circled features in FIG. 11 are selected, it means that the composed music takes the structure having plural sections shown in FIG. 9. However, there is a high possibility that the music of this case has not desired musically natural connections in the series of chords obtained after having designated sections such as "musical highlight" at step 206, because the chord set corresponding to melody section B is copied to paste both after "Intro" and before "Ending" by the indications of "musical highlight" at the beginning and its repetition. Namely, the series of chords determined at step 204 may have to be changed.

Accordingly, to cope with such a possible defect, the unnatural chord connection is corrected at step 208. In the chord correction process, the first and second chord correction method above described can be applied. Once such correction method is applied, the user need not worry any more about naturalness of chord connection even when he adopts "musical highlight" at several sections of the music.

At next steps 210 and 212, the music scale mode is detected, just as in case of steps 126 and 128 in FIG. 3, then the melody is eventually generated. The execution of this automatic composition program which can thus compose automatically a music containing melodies and chords with appropriate portions of "musical highlight" is terminated at step 130.

With such an automatic composition method, a music having its climax at several points and having full of variety can be easily constructed by designating a given "musical highlight" at the beginning and/or at the end, or by repeating it. The "musical highlight" can become still more variant by adding transposition data to the inputted melody generation data for the additionally established "musical highlight" portion, which makes possible to compose automatically a musically rich music. At the process of step 208, the connection portion between the chord determined for the added "musical highlight" portion and the series of given chords is corrected so as to bring a musical naturalness. Under such condition, even when a "musical highlight" portion is added, a given chord progression does not become unnatural, which enables the system to generate automatically a music of high quality.

In the above described example of automatic composition, a musical structure is established by operating Group of Manipulating Knobs 12 according to displayed message on Display Unit 13 for music structure selection. But, instead of this electronic way, it is also possible to dispose the mechanical switches identical to the displayed status as shown in FIG. 11, and then, manipulating such switches, to establish a music structure.

In the various kinds of embodiment above described, the present invention is applied, in common, to the musical sound generation apparatus whose structure is shown in FIG. 1. However, this invention can be applied not only to this type of embodiment, but also to many other types such as electronic musical instrument, PC apparatus combined with application software, karaoke apparatus, PC game apparatus, portable communication terminals like portable personal telephone, and automatic playing piano. In case of portable communication terminal, for instance, all aimed functions cannot always be realized by the terminal only. Then, in order to complete it, it is possible to let a part of the functions go to a server so that the whole system consisting of terminal and server can realize the aimed functions.

Additionally, in case of an embodiment of electronic musical instrument type, the type is not limited to a keyboard instrument, but can be other types such as stringed instrument type, wind instrument type, and percussion instrument type. Moreover, not limited to the electronic musical instrument integrating a sound source apparatus and automatic play apparatus and other apparatuses, it can be composed of separate apparatuses connected by various transmission means such as MIDI devices, other kinds of network.

Lastly, this invention may be practiced or embodied in still other ways without departing from the spirit or essential character thereof as described heretofore. Therefore the preferred embodiment described herein is illustrative and not restrictive, the scope of the invention being indicated by the appended claims and all variations which come within the meaning of the claims are intended to be embraced therein.

What is claimed is:

1. A chord progression correction apparatus comprising:

means for inputting a series of predetermined chords having a musically natural progression;

chord change means for changing a part of the series of predetermined chords; and chord correction means for automatically correcting a chord adjacent to the part changed by the chord change means to generate a new series of chords having a musically natural chord progression.

2. The chord progression correction apparatus as claimed in claim 1, wherein the chord correction means includes:

a table memorizing conditions for a musically natural chord progression; and chord determination means for determining the chord adjacent to the changed part by referring to the table according to two chords which are positioned on the both sides of the chord adjacent to the changed part, one of the two chords being included in the changed part, and another one of the two chords being included in the series of given chords.

3. A chord progression correction apparatus comprising:

an input section that inputs a series of predetermined chords having a musically natural progression;

a chord change section that changes a part of the series of predetermined chords; and a chord correction section that automatically corrects a chord adjacent to the part changed by the chord change section to generate a new series of chords having a musically natural chord progression.

4. A method for correcting a chord progression comprising the steps of:

providing a series of predetermined chords having a musically natural chord progression;

changing a part of the series of predetermined chords; and correcting a chord adjacent to the part changed by the changing step to generate a new series of chords having a musically natural chord progression.

5. A method for correcting a chord progression as claimed in claim 4, wherein the chord-adjacent to the changed port is determined by referring to a condition table according to two chords which are positioned on the both sides of the chord adjacent to the changed part, one of the two chords being included in the changed part, and another one of the two chords being included in the series of predetermined chords, wherein the condition table memorizes conditions for a musically natural chord progression.

6. A method for correcting a chord progression as claimed in claim 4, wherein the step of correcting a chord adjacent to the changed part includes the steps of:

analyzing the series of predetermined chords to detect a feature of the series of predetermined chords; and determining the chords adjacent to the changed part by referring to a condition table according to the detected feature of the series of predetermined chords and two chords which are positioned on the both sides of the chord adjacent to the changed part, one of the two chords being included in the changed part, and another one of the two chords being included in the series of predetermined chords, wherein the condition table memorizes conditions for a musically natural chord progression.

7. A computer readable storage medium storing a computer program applicable to a chord progression correction apparatus, the computer program comprising codes for:

inputting a series of predetermine chords having a musically natural chord progression;

changing a part of the series of predetermined chords; and automatically correcting a chord adjacent to the changed part to generate a new series of chords having a musically natural chord progression.

8. A chord progression correction apparatus comprising:

means for inputting a series of predetermined chords having a musically natural chord progression;

means for inputting a motif melody;

determining means for determining a chord appropriate to the input melody to provide a musically natural progression with the series of predetermined chords; and chord replacement means for replacing a part of the series of predetermined chords with the chord determined by the determining means.

9. A chord progression correction apparatus as claimed in claim 8, wherein the chord determining means comprises:

chord list means for listing a plurality of chords appropriate to the input melody; and chord selecting means for selecting one chord from among the plurality of listed chords to provide a musically natural progression with the series of predetermined chords.

10. A chord progression correction apparatus comprising:

an input section that inputs a series of predetermined chords having a musically natural chord progression;

an input section that inputs a motif melody;

determining section that determines a chord appropriate to the input melody to provide a musically natural progression with the series of predetermined chords; and chord replacement section that replaces a part of the series of predetermined chords with the chord determined by the determining section.

11. A chord progression correction method comprising the steps of:

inputting a series of predetermined chords having a musically natural chord progression;

inputting a motif melody;

determining a chord appropriate to the input melody to provide a musically natural progression with the series of predetermined chords; and replacing a part of the series of predetermined chords with the chord determined by the determining step.

12. A chord progression correction method as claimed in claim 11, wherein the step of determining a chord includes the steps of:

listing a plurality of chords appropriate to the input melody; and selecting one chord from among the plurality of listed chords to provide a musically natural progression with the series of predetermined chords.

13. A chord progression correction method as claimed in claim 12, wherein at least one of plurality of notes that constitute each chord of the plurality of listed chords is coincident with at least one note included in the melody.

14. A chord progression correction method as claimed in claim 11, wherein the step of determining a chord includes the steps of:

listing a plurality of chords appropriate to the input melody; and selecting one chord from among the plurality of listed chords to provide a musically natural progression with the series of predetermined chords by referring to a table that memorizes conditions for a musically natural chord progression.

15. A chord progression correction method as claimed in claim 11, wherein the step of determining a chord includes the steps of:

analyzing the series of predetermined chords to detect a feature of the series of predetermined chords;

listing a plurality of chords appropriate to the input melody;

determining a plurality of chords satisfying the detected feature from among the plurality of listed chords;

selecting one chord from among the plurality of selected chords to bring a musically natural connection with the series of predetermined chords.

16. A chord progression correction method as claimed in claim 11, wherein the step of determining a chord includes the steps of:

analyzing the series of predetermined chords to detect a feature of the series of predetermined chords;

listing a plurality of chords appropriate to the input melody;

determining a plurality of chords satisfying the detected feature from among the plurality of listed chords;

selecting one chord from among the plurality of selected chords to bring a musically natural connection with the series of predetermined chords by referring to a table that memorizes conditions for a musically natural chord progression.

17. A computer readable storage medium storing a computer program containing codes for:

inputting a series of predetermined chords having a musically natural chord progression;

inputting a motif melody;

determining a chord appropriate to the input melody and provide a musically natural progression with the series of predetermined chords; and replacing a part of the series of predetermined chords with the determined chord.

* * * * *